US005613538A

United States Patent [19]

Brisson

[11] Patent Number: 5,613,538

[45] Date of Patent: Mar. 25, 1997

[54] KNIFE HOLDER FOR TIMBER SHAPING AND CHIP PRODUCING HEAD

[75] Inventor: Maurice Brisson, Laval, Canada

[73] Assignee: Denis Comact Inc., St-Georges Beauce, Canada

[21] Appl. No.: 544,929

[22] Filed: Oct. 18, 1995

[51] Int. Cl.[6] ..... B27G 13/00

[52] U.S. Cl. ..... 144/228; 83/698.41; 144/220; 144/223; 144/241

[58] Field of Search ..... 144/39, 176, 162.1, 144/218, 220, 223, 225, 228, 231, 241, 373; 83/666, 698.41; 407/37, 40, 41, 46, 95, 101, 104

[56] References Cited

U.S. PATENT DOCUMENTS 531,154 12/1894 Bruno ..... 144/223
4,241,633 12/1980 DeLuca ..... 83/698.41
4,266,584 5/1981 Lomnicki ..... 144/223
4,456,045 6/1984 Gregoire ..... 144/39
4,793,390 12/1988 Stroud ..... 144/220
5,511,597 4/1996 Shantie et al. ..... 144/220

*Primary Examiner*—W. Donald Bray
*Attorney, Agent, or Firm*—Dvorak and Traub

[57] ABSTRACT

The disclosure herein describes a knife holder forming part of a timber shaping and chip cutting head; the holder defines a flat shaped body bent in an open V-shape to form two integrally joined portions, one of which provides a surface for mounting upon a rotatable core and the other serves to secure the chip cutting knife. The head is formed of a plurality of adjacently disposed knife holders radially mounted on the face of said rotatable core, said face being perpendicular to the axis of rotation. The knife is removably mounted upon the knife holder in a manner that the knife can be rotated so that more than one cutting edge may be used.

15 Claims, 4 Drawing Sheets

KNIFE HOLDER FOR TIMBER SHAPING AND CHIP PRODUCING HEAD

FIELD OF THE INVENTION

The present invention pertains to a knife holder forming part of the rotatable head of a timber shaping and chip producing machine, such as a chipper-canter.

The cutting tool assembly consists of a series of chip cutting knives which are attached to a cylindrical core. The manner of radially face mounting the particularly shaped knife holders causes the knife cutting edges to generate the form of a truncated cone when the entire assembly is rotating.

BACKGROUND OF THE INVENTION

Presently used chipping heads generating a conical cutting pattern have their knives either attached directly to a rotor of roughly conical shape or have their knives mounted by means of appropriately shaped holders upon the peripheral faces of a polygonal core. One example of a knife holder mounted to a polygonally shaped head may be found in applicant's co-pending U.S. application Ser. No. 08/371,164 filed Jan. 11, 1995.

Major inconveniences are found in existing so-called conical head designs. One is the high cost of fabricating a dynamically balanced rotor of polygonal shape. Another is the uplifting effort from the cutting action being applied entirely to the front mounting screws of the holder, thus generating critical tensional stresses in these elements. The inaccurate lateral positioning of the knife holder, and consequently of the knife itself, due to the diametrical clearances (up to 1/16") between mounting holes and screws in the knife holder, is another major disadvantage. Furthermore, the positioning of the knife on the knife holder is equally inaccurate because similar mounting means are used. Consequently, it is necessary to use in every knife replacement, adjusting screws provided on the knife holder to line up the timber finishing edges of each set of knives on a chip cutting head after the knives have already been jig babbitted and length rectified in the filing room. Knife fabrication of a bent plate design now in common use is expensive as it involves the forming and machining of curved surfaces in addition to cutting the required adjusting slots and babbitting recesses. Equivalent complications exist for the user in the grinding and fitting of such knives for everyday use. Additional inconveniences include the expensive knife holder construction from a steel casting, the extra weight involved and, at times, the availability problems of the castings. There is also the problem of abrasion wear on the majority of knife holders which are of a four-wall construction, plus some chip deterioration due to impact with the holder outer wall. Desirable diameter reduction of the cutting circle for heads using the four-sided knife holder is limited due to the space requirements between the holders to allow chip exit out of the cutting area. Finally, erosion of the counterknife working face and leading edge sometimes allows the introduction of wood fiber under the tip of the counterknife; the progressive buildup of such fiber causes stretching and sometimes breaking of the knife retaining screws. Any loosening of the knife retaining screws which thread into the counterknife will also allow its leading edge to admit sufficient wood fiber to generate destructive pressures between the knife and knife holder faces.

OBJECTS AND STATEMENT OF THE INVENTION

It is an object of the present invention to overcome the above described problems encountered in existing equipment.

This is achieved by providing a novel knife holder which is adapted to be mounted to the plane face of a circular rotatable core. The knife holder has a flat shaped V-bent body that consists of:

- a face mounting portion having means allowing the knife holder to be radially affixed to a part of the plane face of the core; and
- a knife holding portion extending beyond the face mounting portion and being angularly inclined relatively thereto, the knife holding portion having means to secure a knife for timber forming and chip producing.

The present invention also pertains to an improved rotatable head for a timber shaping chip producing machine that has a drive shaft, the head comprising:

- a rotatable core having a plane circular face and a cylindrical hub portion adapted to be mounted to the drive shaft; the circular face displaying an annular projection extending concentrically to the rotatable shaft of the machine;
- a plurality of adjacently disposed knife holders mounted to the circular face; each knife holder including a first radial portion defining an underface secured to the circular face and displaying a recess correspondingly receiving therein a portion of the annular projection; each knife holder including a knife holding portion integrally extending beyond a V bend line in the knife holder;
- means for securing the radial portion of each knife holder to the circular face;
- a knife mounted to each of the knife holding portions; and
- means for removably mounting the knife to the knife holding portion; the knife being so disposed on the holding portion so that, upon rotation of the shaft, the knife will shape timber and produce chips.

As mentioned above, one of the most common styles of knife mounting found in chipper canters is the one using a knife holder having a base which is affixed to the peripheral faces of a polygonal rotor, with resulting inaccurate lateral positioning of the holder and therefore of the knife itself. The knife holder of the present invention is attached in its mounting portion to the front face of the circular core plate, in a plane perpendicular to its rotating axis. Since the mating faces of both the knife holders and core plate are flat machined (with the exception of the interlocking key and keyway arrangement) all the holders are therefore aligned in a single mounting plane, this alignment being positively secured by tightening the mounting screws. Furthermore, the knife itself is accurately positioned and securely held in place by means described hereinbelow.

The knife mounting assembly of this invention comprises a counter-knife (or chipbreaker) which is, as the cutter knife itself, of double ended symmetrical construction. Each working face is surface hardened and the mounting face is concave ground in the lengthwise direction. The face hardening will reduce wear from chip abrasion; the reversible feature will also extend the service life before face grinding or part replacement is needed. The hollow grinding of the mounting face allows the counterknife to flex under screw tensioning which maintains the knife mounting screws under tension and therefore assists in locking the thread against rotation. The additional effect of the curved counterknife face is to insure tight contact of its leading edge, thus preventing wood fiber from being pushed in between the knife and counterknife.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
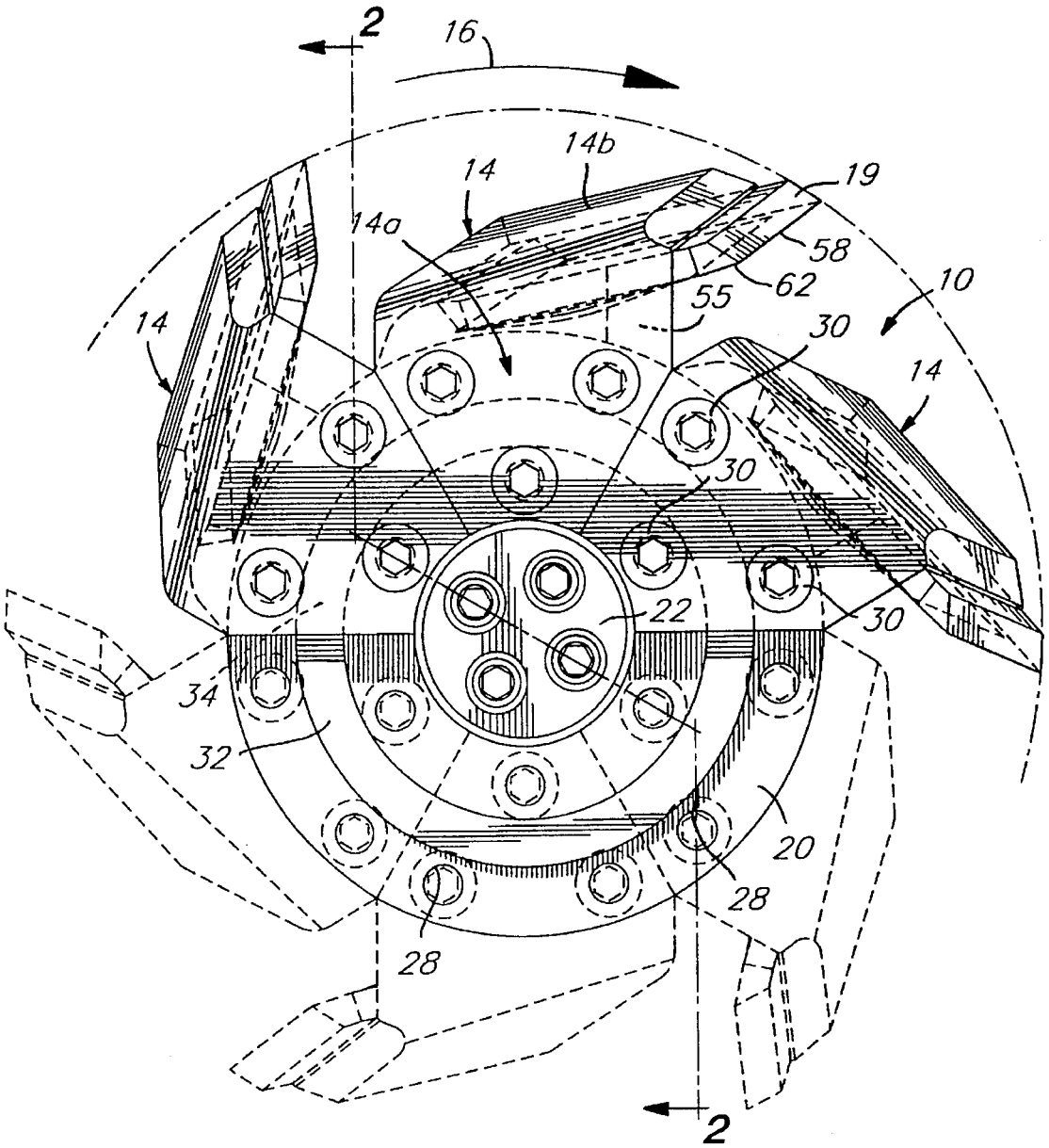
FIG. 1 is a front elevational view of a rotatable chipping head using a series of knife holders made in accordance with the present invention.
Figure 2:
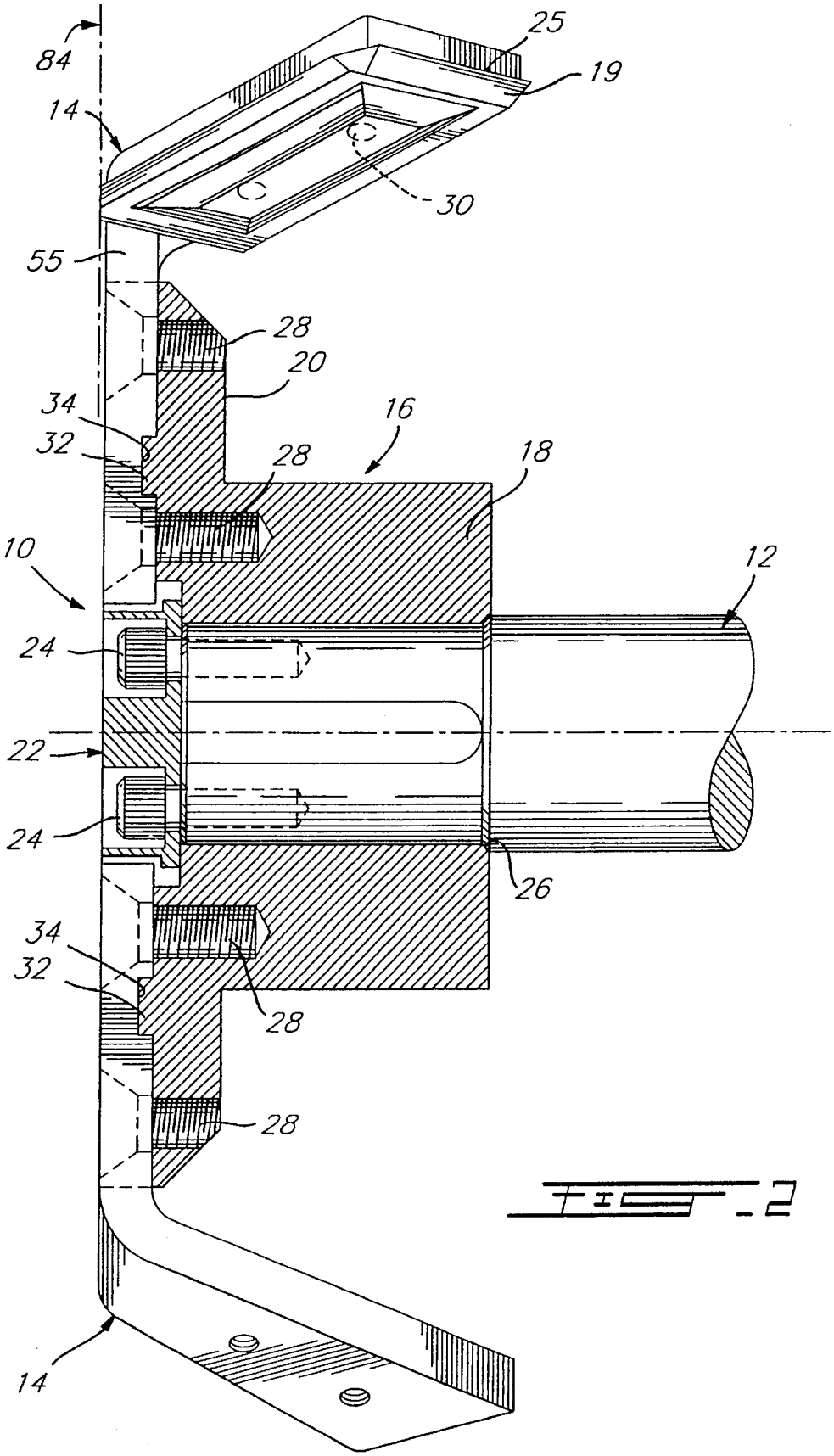
FIG. 2 is a cross sectional view taken along lines 2—2 of FIG. 1.

Referring to FIGS. 1 and 2, there is shown a head, generally denoted 10, of a timber shaping and chip producing machine (not shown) having a rotatable drive shaft 12. The head 10 consists basically of a series of knife holders, generally denoted 14, radially mounted to a circular core 16 having a cylindrical hub portion 18 and a circular front plate 20. The hub part 18 and the plate 20 may be an integral body as shown in the drawings or may consist of two separate parts fixedly connected to one another. A circular cap 22 mounted by means of screws 24 to the end of shaft 12 serves to prevent axial movement of the core 16 by pressing the hub portion 18 against a shoulder 26 on the shaft 12. The front plate 20 has threaded holes 28 to receive mounting screws 30 for securing the knife holders 14 to the head. Each knife holder 14 is further locked into position onto the plate by means of a concentrically machined key and keyway arrangement 32, 34 between the outer face of the plate and the mounting face of the knife holder. It will be obvious to a person skilled in the art that the key and keyway arrangement may be different from that shown in the drawings where the key would be on the underface of the knife holder and the keyway in the circular face of the plate.

As the above described, the head consists of a circular hub portion to one side of it, the entire piece, being bored and keywayed for mounting on a shaft, this compares favourably in cost with any multifaced core having sufficient dimension for peripheral mounting of knife holders.

Figure 3:
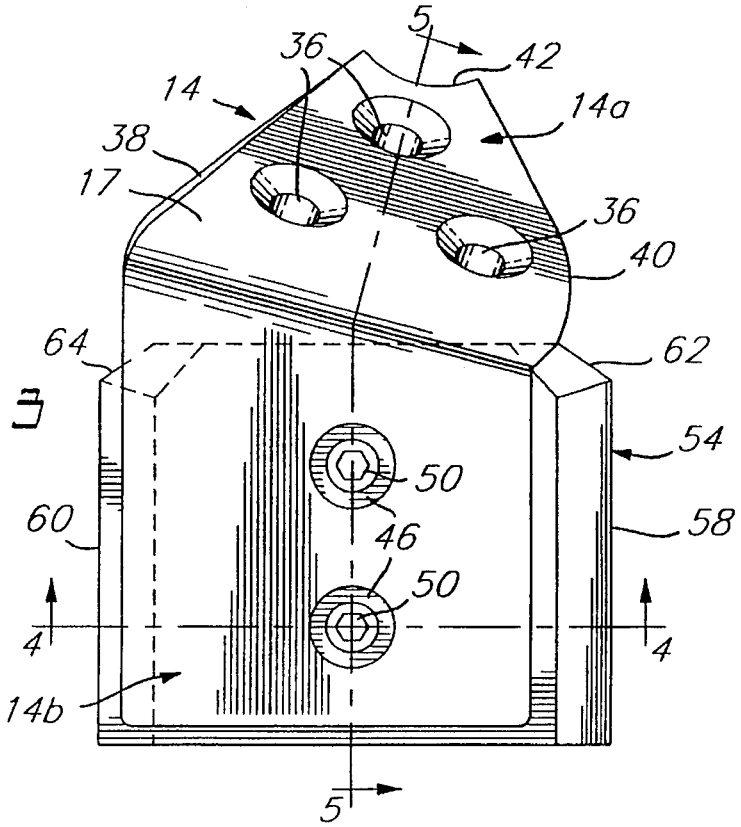
FIG. 3 is a top plan view of the knife holder.
Figure 4:
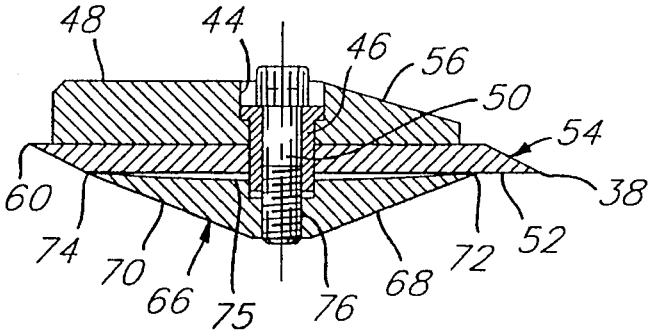
FIG. 4 is a cross sectional view taken along lines 4—4 of FIG. 3.
Figure 5:
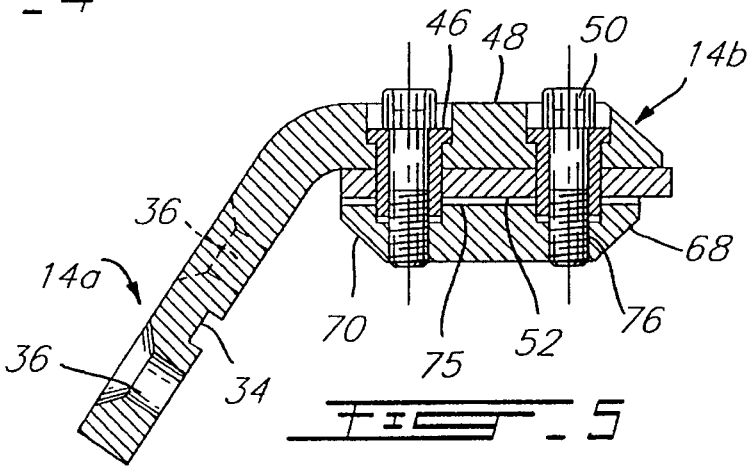
FIG. 5 is a cross sectional view taken along lines 5—5 of FIG. 3.

Referring to FIGS. 3–5, the knife holder 14 defines a flat shaped V-bent body that comprises a face mounting portion 14*a* and a knife holding portion 14*b* . The face mounting portion 14*a* includes three holes 36 which are configured to come into alignment with the three threaded holes 28 of the circular plate 20 to allow the fastening screws 30 to secure portion 14*a* radially onto the outer face of the circular core face. As illustrated in FIG. 1, the keyway 34 defines the shape of an arc of a circle while the key is in the form of an annulus on the outer face of the core. Each portion 14*a* displays two opposite radial edges 38 and 40 converging to a concave front edge 42.

The knife holding portion 14*a* of the knife holder defines a generally rectangular portion which is integral with portion 14*b* and projects outwardly beyond a bend line. Portion 14*b* comprises a pair of openings 44 to receive large diameter dowels 46 which are pressed into the holes and secured therein by means of a welding bead or a machined shoulder. One end of the dowels is recessed below the top face 48 of the knife holder to receive the head of the knife mounting screws 50 whereas the opposite end protrudes through corresponding holes in and beyond the knife. These dowels also have a centrally drilled hole to let the screw through the assembly and past the lower surface 52 of the knife 54.

The knife holder mounting face is flat machined and therefore can be used as a reference plane to locate knife mounting holes in the portion of the holder extending beyond the core face diameter. By tightly fitting and securing large diameter dowels into these holes, in such a manner that they will protrude through precisely located matching holes in the knife, the mounting position is exactly repeated for every knife on the same cutter head. Since the knife holders have been precisely located against the core face, the end result is that perfect alignment of the timber finishing edge 84 of the knives on each head will be obtained without repeated time consuming adjustments of each knife to be installed on the head, thus automatically insuring smooth face finish for the shaped timber.

The body of the knife holder can be constructed from a single flat steel plate, rough shaped by flame cutting and bent to about 60 degrees along a single transversal line. The mounting portion 14*a* is faced on both sides, drilled for mounting screws and keywayed on its inner face to match the circular concentric key of the core face. The two sides 38 and 40 of this wedge shaped portion of the holder are also machined to insure full lateral contact of any holder with the ones on either side.

The knife carrying portion 14*b* is faced on its underside and is drilled to receive the press fitted dowels which are subsequently welded or otherwise secured in place, then drilled for passage of the knife mounting screws. The vertical front part 55 of the holder is also relieved at an approximately 30 degree angle starting from its outer edge, in the area between the lower face of the knife and the outer periphery of the rotor face, to provide passage of the chips produced just inside the holder outer face.

The knife 54 is built from a flat alloy steel plate of high wear resistance. It is ground at both ends in a symmetrical pattern of two cutting edges 58 and 60 which insure cross fibre cutting for chip making; two cutting edges 62 and 64 provide finishing cuts on the timber face 84 (see FIG. 6). The holes 44 are centrally located between the knife extremities, thus permitting use of said knife in either mounting direction. The hole diameter is closely fitted to the dowel size so that the knife is accurately positioned and securely held from lateral or endwise motion.

The knife used with the present invention can be produced from flat steel plate without the need of forming or machining operations other than hole drilling in the center and grinding of the cutting edges. The knife which can be rotated to make full use of its cutting edges is made of an alloy steel of superior wear quality than obtained by heat treating the formable carbon based steels used in current designs. The net result therefore is a knife which has a low production cost and a long service life with no adjustment required at installation and no maintenance costs such as grinding, babbitting and length rectification.

The knife holder 14 also comprises a counterknife 66, the function of which is to lift the cross fiber cut chips from their side face adhesion to the solid wood mass. The counterknife is symmetrical in all respect; therefore, it can be mounted in both directions longitudinally in the same manner as the knife 54. The counterknife has working faces 68 and 70 at both ends which are surface hardened and the edges 72 and 74 at both extremities bear on the knife surface 52 in little more than line contact because of the concave ground contact face 75 of the counterknife. This feature effectively prevents wood fiber introduction between the knife and the counterknife; it also has the effect of making the part somewhat flexible under screw tightening pressure and to act in the manner of a spring type lock washer to prevent loosening of the knife mounting screws.

The counterknife includes threaded holes 76 to engage with the knife mounting tightening screws 50; these holes are counterbored to accommodate the lower end of the dowels 46. This ensures positive locating of the counterknife.

It will be evident to the person skilled in the art that the knife of the present invention could be modified to provide maximum use. For example, three of the four sides of the rectangular shape knife could be provided with cutting edges and finishing edges. Such knife would include four holes to thereby allow successive 90° rotation of the knife with respect to the holding portion of the knife holder. In providing the knife with two additional holes, located along an axis perpendicular to the axis including the two holes illustrated in FIGS. 1–5, a 90° rotation of the knife would result in having these two additional holes in registry with the two holes 46 of the knife holder.

Figure 6:
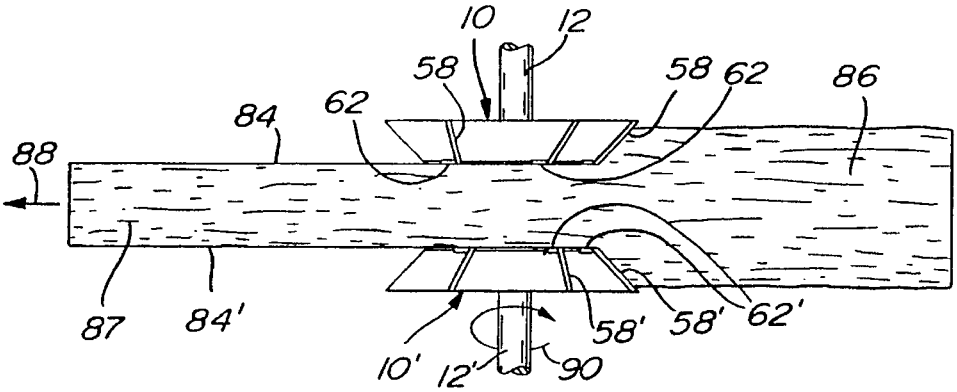
FIG. 6 is a schematic view showing two 10 chipping heads canting a log.

FIG. 6 illustrates two timber facing heads 10 and 10' working opposite one another to produce two parallel flat sides 84 and 84' on an originally round log 86 moving through the process in the direction of arrow 88. The heads both rotate in the direction of arrow 90 and carry schematically drawn knives having a cross fiber cutting edge 58, 58' and timber face finishing edge 62, 62'. The final result of the operation leaves a two parallel sided piece of timber 87 and a residual volume of wood chips to be used in paper making. The two sided timber produced can be put through the same process once again in order to form a four-sided timber and additional chips.

The uplifting force generated by the cutting action on current knife holders is converted, in the present knife mounting, into a twisting moment resisted in shear by the mounting screws, with the assistance of the interlocking key and keyway arrangement between the mounting face of the knife holder and the core face, plus the lateral contact of the knife holders with one another, over the core face area. The resulting mounting solidarity of the holders and their interlocking face mounting contact make any relative movement of the overall assembly components virtually impossible, even if some of the mounting screws should become loose.

The radially mounted knife holder of the present invention is produced from steel plate flame cut to shape and bent by approximately 60 degrees across its width. Finishing operations include facing of contact surfaces and drilling the mounting holes. Dependence on foundries for availability and cost of castings, plus complicated machining sequences are eliminated by the design simplicity.

A negative feature of most present knife holder constructions is the 4-wall open-ended box configuration which tends to funnel the chips from one holder to the next one behind, this having a detrimental effect on both the holder and the chips produced, by causing abrasive wear on the former and fiber splintering of the latter. The holder of the present invention totally eliminates this effect by having a single wall for knife mounting and a totally open side for free lateral chip exit.

The single wall knife holder design of this invention, being open sided for free lateral chip ejection, allows closer mounting of the chipping knives than the four-sided holder configuration. As a result, chipping heads of smaller diameter to be fitted into more timber squaring, slabbing and edging operations, can be built with the help of the single wall, radially mounted knife holder.

It is to be noted that regardless of the advantages of the reversible disposable knife, the present knife holder design does not preclude mounting of the conventional bent and slotted knife, with babbitted back-up and adjusting screws. Minor modifications in the knife seat machining, plus welding of a push-pull screw equipped back-up plate at the rear end of the holder, would allow mounting of bent slotted knives similar to those used at this time on present day canters. Whichever of the two knife styles are used on the new circular core and radially mounted knife holder, the basic advantage of precise lateral location of the timber finishing edge of each knife is retained through the exact positioning of the holder with regard to the finished timber face, plus the added benefits of the open sided chip exit and cost reduction of the equipment.

Figure 7:
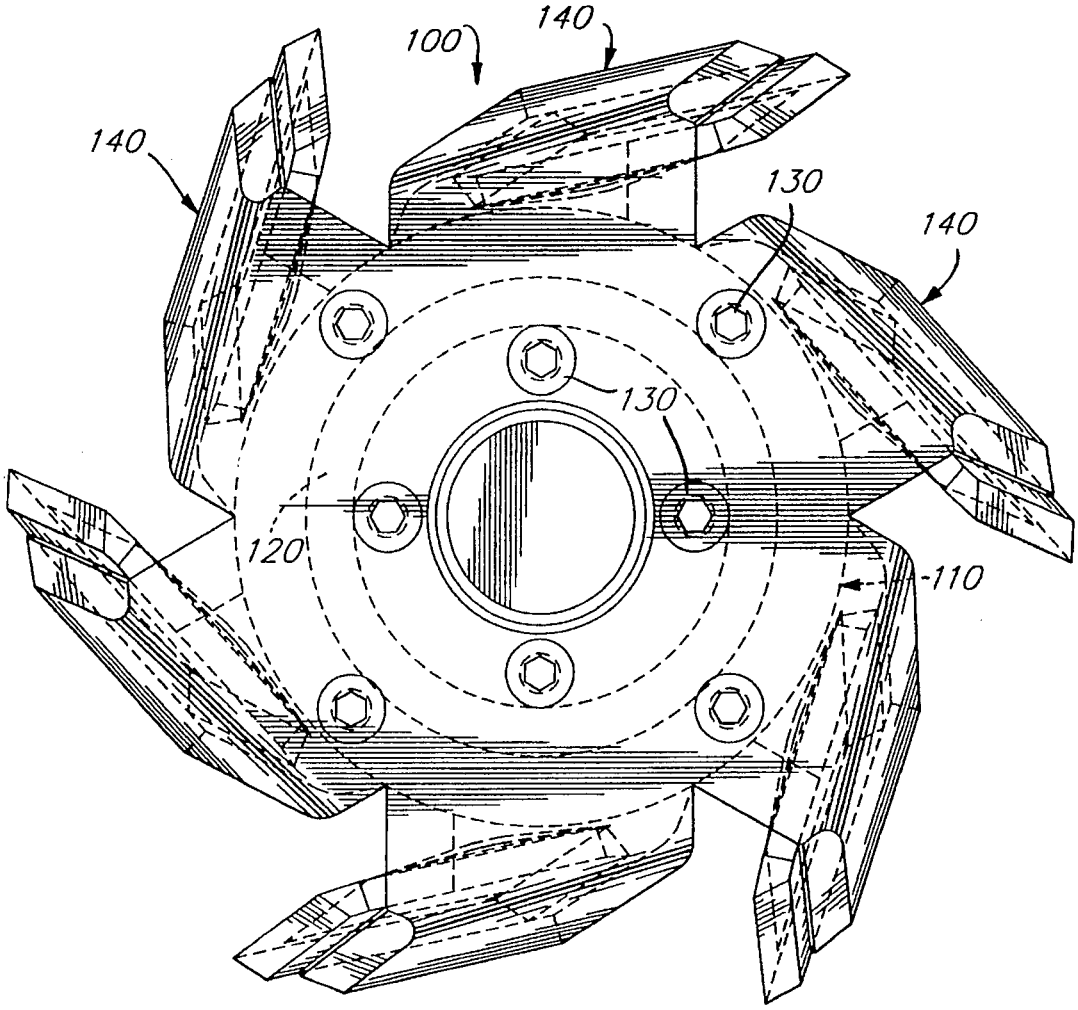
FIG. 7 is a front elevational view of another embodiment of a rotatable chipping head made in accordance with the present invention.

FIG. 7 illustrates another embodiment of the knife holder of the present invention. The construction of this knife holder differs from that illustrated in FIGS. 1–6 in that a single knife holder 100 (instead of six) is mounted to the rotatable core of a timber shaping and chip producing machine. The resulting head is identical to the head of FIGS. 1–6 with a rotatable core having a plane circular outer face and a hub portion mounted to the drive shaft of a chipper-canter, for example. The circular face displays the same annular key (as shown in FIGS. 1–6) that extends concentrically to the rotatable shaft of the machine. The knife holder includes a single circular portion 110 with an underface keyed to the circular face of the core and with an annular keyway 120 in which is received the annular key of the circular face. This central portion is secured to the face by a series of fastening bolts 130. From this central portion, integrally extends a plurality of knife holding portions 140 projecting beyond a bend line from the main circular portion. A detailed description of each holding portion 140 with its knife and counterknife will not be given as it is identical to the knife holding portions **14*b* of the embodiment illustrated in FIGS. 1–6**.

Although the invention has been described above with respect with one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A knife holder for use in a rotatable head of a timber shaping and chip producing machine, said head including a rotatable core having a circular mounting face, said knife holder comprising a flat shaped V-bent body consisting of:

a face mounting portion having a means for radially affixing the face mounting portion to a part of said circular face of said core; and a knife holding portion extending beyond said face mounting portion and being angularly inclined relatively thereto, said knife holding portion having means to secure a knife for timber shaping and chip producing.

2. A knife holder as defined in claim 1, wherein said face mounting portion defines a plane contacting underface; said means for radially affixing said face mounting portion to said circular face of said core including a first locating means cooperating with a corresponding second locating means on said circular face.

3. A knife holder as defined in claim 2, wherein said first locating means consists of an arc-shaped keyway in said underface and wherein said second locating means consists of an annular key in said circular face.

4. A knife holder as defined in claim 2, wherein said means for radially affixing the face mounting portion to said circular face of said core further includes a plurality of holes for receiving therein a fastening means to secure said knife holder to said circular face.

5. A knife holder as defined in claim 1, wherein said means to secure a knife consist of hole means for tightly receiving fitted dowels protruding through corresponding hole means in the knife.

6. A knife holder as defined in claim 1, wherein said face mounting portion defines opposite radially extending side edges fitted into tight contact with adjacent holders, and terminating into an arc-shaped end.

7. A knife holder for use in a rotatable head of a timber shaping and chip producing machine, said head including a core having a circular mounting face, said holder comprising:

(a) a flat shaped V-bent body consisting of:

i) a face mounting portion having means allowing said portion to be radially affixed to a part of said circular face; and ii) a knife holding portion extending from said face mounting portion beyond a V bend line in said body; said knife holding portion having an underface;

(b) a knife bearing against said underface; and (c) means for locating and securing said knife against said underface.

8. A knife holder as defined in claim 7, wherein said securing means comprise a counter-knife bearing against an underface of said knife and means for forcing said counter-knife to bear against said underface of said knife.

9. A knife holder as defined in claim 8, wherein said counter-knife defines a concave face, the extremities of which bear against said underface of said knife.

10. A knife holder as defined in claim 8, wherein said securing means consist of dowel means and bolt means extending in holes through said knife holding portion, said knife and said counter-knife.

11. A knife holder as defined in claim 10, wherein said knife has a quadrilateral shape and defines opposite cutting edges; said bolt means being releasable to allow knife rotation to provide further timber shaping and chip producing from additional cutting edges of said knife.

12. A knife holder as defined in claim 11, wherein said opposite cutting edges further include timber finishing edges.

13. A rotatable head for a timber shaping and chip producing machine having a drive shaft, comprising:

a rotatable core having a plane circular face and a hub portion adapted to be mounted to said drive shaft; said circular face displaying an annular projection extending concentrically to the rotatable shaft of the machine;

a plurality of adjacently disposed knife holders mounted to said circular face; each said knife holder including a first radial portion defining an underface secured to said core circular face and displaying a recess correspondingly receiving therein a portion of said annular projection; each said knife holder including a knife holding portion integrally extending beyond a V bend line in said knife holder;

means for securing said radial portion of each knife holder to said circular core face;

a knife mounted to each of said knife holding portions; and means for removably mounting said knife to said knife holding portion; said knife being so disposed on said holding portion that, upon rotation of said shaft, each said knife shapes timber and produces chips.

14. A rotatable head for a timber shaping and chip producing machine having a drive shaft, comprising:

a rotatable core having a plane circular face and a hub portion adapted to be mounted to said drive shaft; said circular face displaying first annular means extending concentrically to the rotatable shaft of the machine;

a knife holder mounted to said circular face; said knife holder including a main circular portion defining an underface secured to said circular face and displaying second annular means correspondingly engaging said first annular projection; said knife holder further including a plurality of knife holding portions integrally extending beyond a V bend line from said main circular portion;

means for securing said main circular portion to said circular face;

a knife mounted to each of said knife holding portions; and means for removably mounting said knife to said knife holding portion; said knife being so disposed on said holding portion that, upon rotation of said shaft, each said knife shapes timber and produces chips.

15. A rotatable head as defined in claim 14, wherein said first annular means consists of an annular projection on said circular face and wherein said second annular means consist of an annular recess in said underface.

* * * * *